US005594476A

United States Patent [19]

Tokunaga et al.

[11] Patent Number: 5,594,476

[45] Date of Patent: Jan. 14, 1997

[54] DRIVING METHOD OF INK JET HEAD AND INK JET APPARATUS

[75] Inventors: Tatsuyuki Tokunaga; Jiro Moriyama, both of Yokohama, Japan

[73] Assignee: Canon Kabushiki Kaisha, Tokyo, Japan

[21] Appl. No.: 383,686

[22] Filed: Feb. 1, 1995

Related U.S. Application Data

[63] Continuation of Ser. No. 988,005, Dec. 9, 1992, abandoned, which is a continuation of Ser. No. 594,666, Oct. 9, 1990, abandoned, which is a continuation of Ser. No. 264,079, Oct. 28, 1988, abandoned.

[30] Foreign Application Priority Data

Oct. 29, 1987 [JP] Japan ..... 62-271844
Oct. 29, 1987 [JP] Japan ..... 62-271845

[51] Int. Cl.[6] ..... B41J 2/045

[52] U.S. Cl. ..... 347/10; 347/68; 347/94

[58] Field of Search ..... 347/10, 9, 11, 347/94, 68, 70

[56] References Cited

U.S. PATENT DOCUMENTS

| | | | |
|---|---|---|---|
| 4,424,520 | 1/1984 | Matsuda | 347/11 |
| 4,743,924 | 5/1988 | Scardouvi | 347/10 |
| 4,897,665 | 1/1990 | Aoki | 347/10 |

FOREIGN PATENT DOCUMENTS

| | | | |
|---|---|---|---|
| 104950 | 6/1984 | Japan | B41J 3/04 |
| 25060 | 2/1987 | Japan | B41J 3/04 |

*Primary Examiner*—Joseph W. Hartary
*Attorney, Agent, or Firm*—Fitzpatrick, Cella, Harper & Scinto

[57] ABSTRACT

A driving method for an ink jet head and an ink jet apparatus using such ink jet head, features charging ink as a droplet from a discharge opening communicated with an ink path to carry out the recording by the pressure generated in the ink by means of an electric-mechanical converting element provided along the ink path. A driving pulse applied to the converting element begins to fall a predetermined time after its application.

6 Claims, 10 Drawing Sheets

DRIVING METHOD OF INK JET HEAD AND INK JET APPARATUS

This application is a continuation of application Ser. No. 07/988,005 filed Dec. 9, 1992, now abandoned, which in turn is a continuation of application Ser. No. 07/594,666 filed Oct. 9, 1990, now abandoned, which in turn is a continuation of application Ser. No. 07/264,079 filed Oct. 28, 1988, now abandoned.

BACKGROUND OF THE INVENTION

1. Field of the Invention

The present invention relates to a method of driving an ink jet head and an ink jet apparatus having the above ink jet head, and more particularly to the method which is featured by discharging ink as a droplet from a discharge opening communicated with an ink passage to carry out the recording by pressure generated in the ink by means of an electric-mechanical converting element provided along an ink path, and the ink jet apparatus provided with the above ink jet head.

2. Related Background Art

A so-called Gould type ink jet head as shown in the FIG. 1 has been known as one of the ink jet heads of this kind.

In FIG. 1, numeral 1 designates a nozzle body having a hollow cylindrical configuration whose tip end is squeezed like a conical configuration, numeral 2 designates a filter disposed on an opened portion at one end of the nozzle body 1, and numeral 3 designates a discharge opening formed by opening a conical head portion of the other end of the nozzle body 1. Numeral 4 designates a cylindrical piezoelectric element to be engaged with a portion around the nozzle body 1, the piezo-electric element 4 is adhered and and fixed to the nozzle body 1 by an adhesive material 5 such as epoxy resin or other adhesive. Numeral 6 designates a driving portion capable of generating a pulse of wave configuration which will be explained in detail hereinafter.

By applying a piezo-electric pulse as shown in the FIG. 2 to the piezo-electric element 4 by the driving portion 6, the piezo-electric element 4 is subject to mechanical displacement, and generating the pressure wave around a point P in FIG. 1 of the nozzle 1. This pressure wave transmits into two directions (forward and rearward), along an ink path of the nozzle body 1. When one side of the pressure wave reaches to the discharge opening 3, the ink will be discharged as a droplet from the discharge opening 3 by operation of the pressure wave. At this time, the discharge opening operates as a fixed end for the pressure wave because an inner diameter of the nozzle tube is extremely reduced as this portion, and accordingly the pressure wave is reflected in the same phase. The filter 2 operates as a free end because it has opened portion like a lotus or honeycomb whose opened rate is more than 80%, and accordingly the pressure wave is reflected with a reversal phase.

FIG. 3 shows the state in which the above two pressure waves are transmitted in the nozzle from reflection. A solid line shows a compressed wave, while a broken line shows an expanded wave. As apparent from FIG. 3, the reflection of the compressed wave and expanded wave become respectively a compressed wave and expanded wave, because both of them are reflected in the same phase at the discharge opening 3 and are again reversed at the filter 2 in turn to become respectively an expanded wave and compressed wave.

Due to the relation between the above reflected pressure waves and an ink viscosity as well as a surface tension, and the relation between the above reflected pressure waves and a refill of the ink after being discharged through the filter 2, a meniscus M of the ink I at the discharge opening 3 presents damped vibration with complex behavior as shown in FIG. 4, and then return to its initial state. Then the next driving voltage pulse is biased to the piezo-electric element 4 to discharge the ink droplet succesively to thereby carry out recording of an image or letter or other record.

By changing a voltage of the driving voltage pulse biased to the piezo-electric element 4, ink droplet quantity to be discharged can be adjusted. Density of the picture element is varied in this way and gradient expression of the image is effected. Furthermore, as shown in the FIG. 2, a fall or drop of the voltage pulse is made slow to prevent occurrence of sudden mechanical displacement, so that any large negative pressure would not be generated at the point P.

However, the reflected pressure wave causes various bad influences. In detail, the pressure wave generated by the fall of the voltage pulse is reflected in the nozzle as shown in FIG. 3, and being transmitted with reversing the discharge opening 3 before the time when a tail of the ink droplet discharged from the discharge opening 3 to fly is not separated from the meniscus M, so there is a danger air bubbles B being trapped in the nozzle 1 as shown in and FIG. 5.

At the time $t_2$ as shown in the FIG. 3, there is a danger that the pressure wave acts to the discharge opening 3 of the nozzle to discharge an unnecessary ink droplets, which deteriorate the quality of the image. For overcoming the above disadvantage, the proposal to cancel the pressure wave of the raised voltage pulse by falling wave configuration at the time $t_2$ as shown in the FIG. 6 has been tried, for example, in the Japanese Patent Laid-Open Application No. 61-266255.

However, the problem of trapping of the air bubble cannot be avoided sufficiently in the above manner because there is no measure provided to the reflected wave at the time $t_1$. Meanwhile, in an ink jet recording printer of analogue modulation in which the gradient expression is effected by varying the discharge ink quantity, variable range of the discharge ink quantity is important. Furthermore, to realize an ink jet recording printer capable of effecting the high quality recording, gradient character as well as resolution is important, so it is necessary to discharge the fine or minute ink droplets to record fine dots. On the contrary, in the wave configuration shown in FIG. 6, the pulse width is too large to record the fine dots, and resultantly is not suitable for the ink jet printer of analogue modulation.

Fine dots can be recorded by the pulse wave configuration in which pulse width is properly shortened and the rise is made slow. For reducing the influence of the reflected pressure wave, an idea to bias the sub-pulse later than the main pulse by the time difference $t_1$ as shown in FIG. 7 to thereby cancel the reflected pressure waves has been proposed. However, since the size of the waves transmitted from two directions to overlap at the time $t_1$ are different, it is impossible to cancel the reflected pressure waves well by the single sub-pulse, which still leaves bad influence leading to delays in refilling.

SUMMARY OF THE INVENTION

It is an object of the present invention to solve the above disadvantage i.e. to provide the driving method of the ink jet and the ink jet apparatus capable of achieving the high speed recording in which air bubble trapping and unnecessary ink discharging are avoided.

It is another object of the present invention to provide an ink jet apparatus comprising an ink jet head having an ink path communicated to a discharge opening discharging an ink and a supply opening supplying the ink, and an electric-mechanical converting element disposed along the ink path; means for applying a driving pulse to said electric-mechanical converting element, the driving pulse having a main pulse, and a sub-pulse rising at the time when a time period 2l/C has passed after rising of the main pulse and falling at the time when the time period 2l/C has further passed after passage of said time period 2l/C, wherein l is a length from the discharge opening to the supply opening, and C is a transmitting velocity of a pressure wave in the ink.

It is still other object of the present invention to provide a method for driving an ink jet head characterized by applying a driving pulse to an electric-mechanical converting element of the ink jet head, said driving pulse having a main pulse, and sub-pulse rising at the time when a time period 2l/C has further passed after passage of the time period 2l/C, wherein l is a length from a discharge opening from which the ink of the ink jet head is discharged to a supply opening to which the ink is supplied, and C is a transmitting velocity of a pressure wave in the ink.

It is still another object of the present invention to provide an ink jet apparatus comprising an ink jet head having an ink path communicated with a discharging opening from which an ink is discharged, and an electric-mechanical converting element provided along the ink path; means for applying a driving pulse to the electric-mechanical converting element, the driving pulse falling at the time when a time period $2l_1/C$ has passed after a rising, wherein $l_1$ is a length from the discharge opening to a center portion of a portion of the ink path where the electric-mechanical converting element is provided, and C is a transmitting velocity of a pressure wave in the ink.

It is still another object of the present invention to provide a driving method of an ink jet head characterized by a driving pulse falling at the time when a time period $2l_1/C$ has passed after a time of rising is applied to an electric-mechanical element, wherein $l_1$ is length from a discharging openig of the ink jet head from which the ink is discharged to a center point of a portion on which the electric-mechanical element is provided of the ink path communicated with the ink discharge opening and C is transmitting velocity of a pressure wave in the ink.

According to the above construction, the pressure wave generated by the rise of the main-pulse is divided into two directions to be reflected, causing raising of the sub-pulse at the time when the pressure waves converge to the pressure generating point after being reversed their phases again, and causing a fall or drop in sub-pulse after the predetermined time period equal to the pulse rising time interval of said two pulses has passed, thus, the reflected pressure waves being cancelled in two steps.

Furthermore, according to the above construction, it is possible to damp pressure of the reflected pressure wave by determining the falling time of the voltage pulse biased to the electric-mechanical converting element based on the relation between the distance of the electric-mechanical converting element and the discharge opening, and the speed of the pressure wave transmitting in the ink.

DETAILED DESCRIPTION OF THE PREFERRED EMBODIMENT

The present invention will be explained in detail on a basis of attached drawings, but it is noted that the present invention is not limited to these embodiments.

Figure 8:
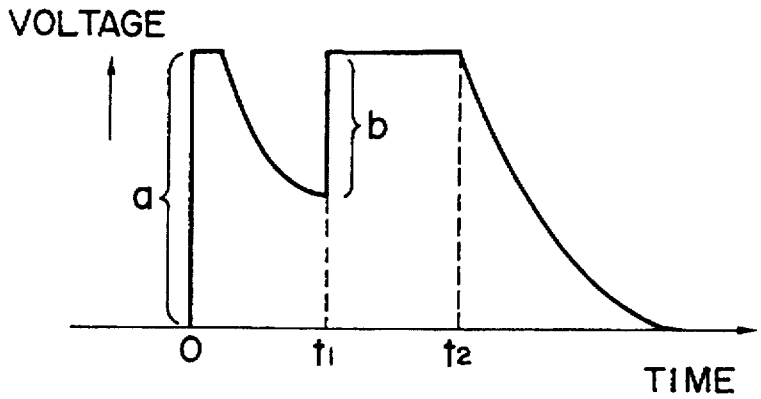
FIGS. 8 to 13 are typical figures showing respectively driving pulse according to various embodiments of the present invention.

FIG. 8 shows one embodiment of the present invention in which a voltage waveform biased to a piezo-electric element 4 is shown. In FIG. 8, $t_1$ shows the time when pressure waves are overlapped in the first time at the point P of FIG. 1, and as apparent from FIG. 3, $t_1$ can be represented as $t_1=2l/C$, wherein lengths of the nozzle body (from the discharge opening to the ink supplying opening to the ink path i.e. a right end of the filter is l, transmitting velocity of the pressure wave in the ink is C. Letter $t_2$ shows the time when the pressure waves are overlapped in the second time, and $t_2$ is equal to double of $t_1$ ($t_2=2t_1$).

Figure 3:
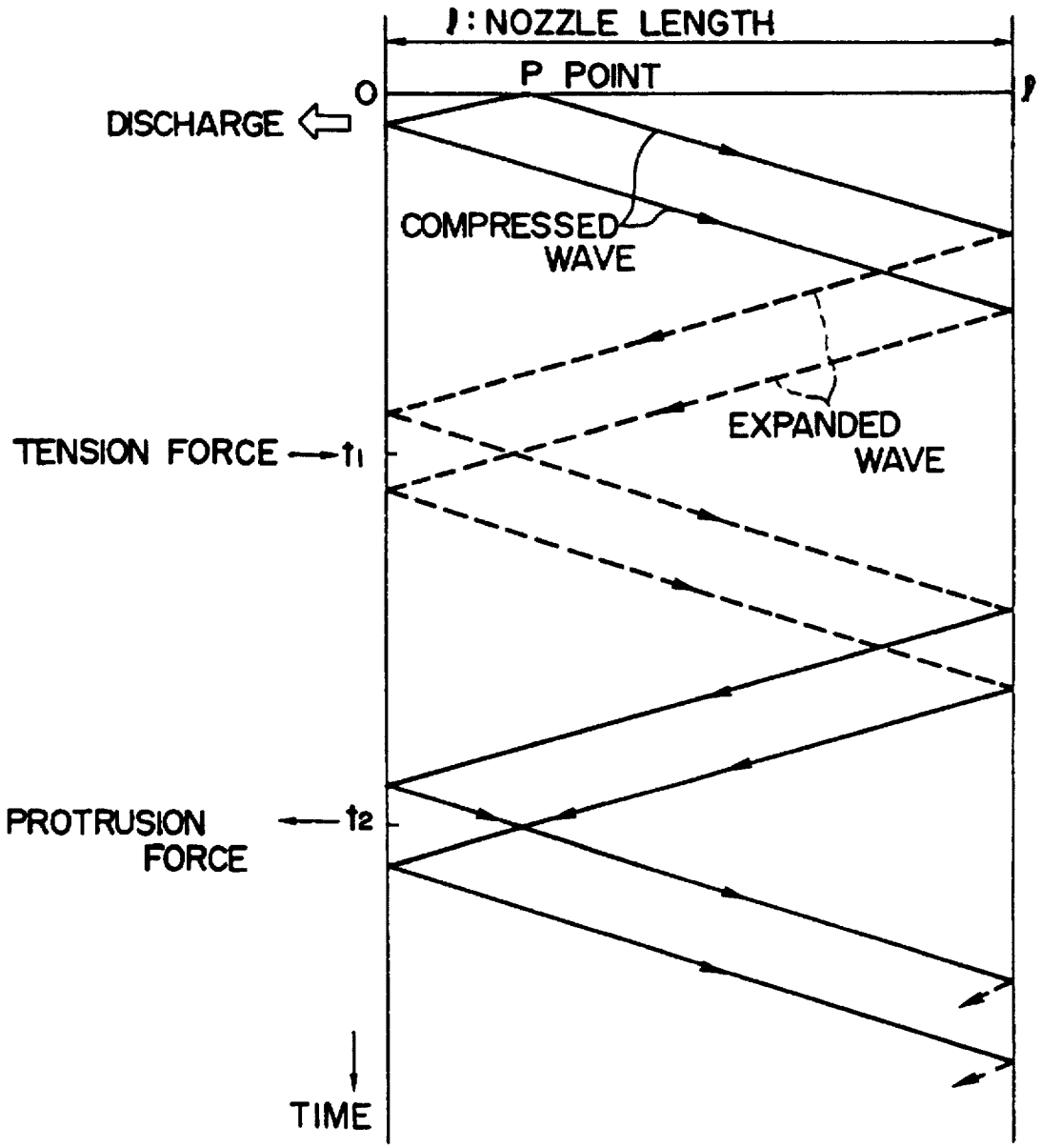
FIG.3 PRIOR ART
FIG. 3 is a drawing explaining a pressure wave being transmitted in an ink path.
Figure 4:
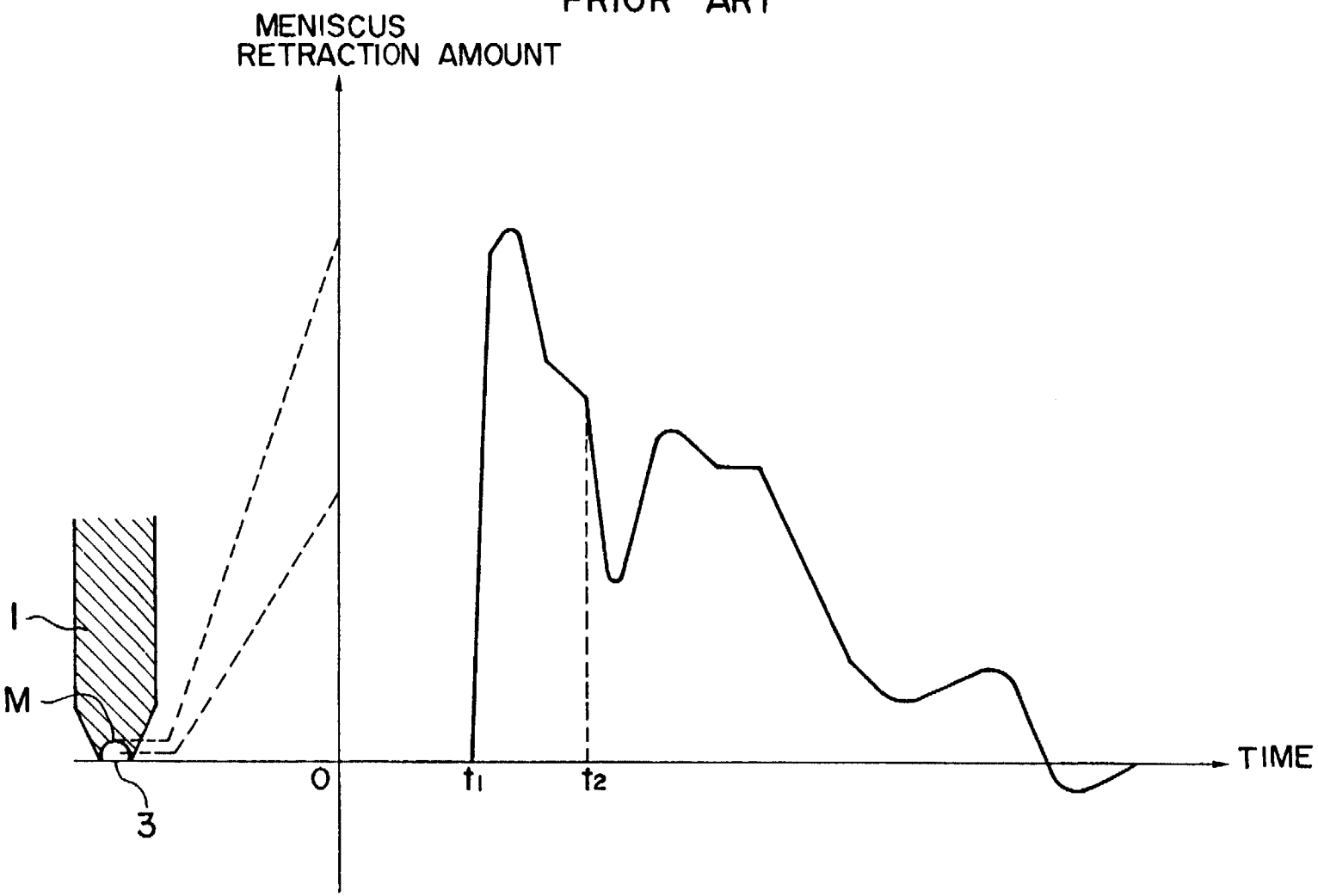
FIG. 4 PRIOR ART
FIG. 4 is a typical figure showing behavior of a menicus at a discharge opening of the prior art.
Figure 5:
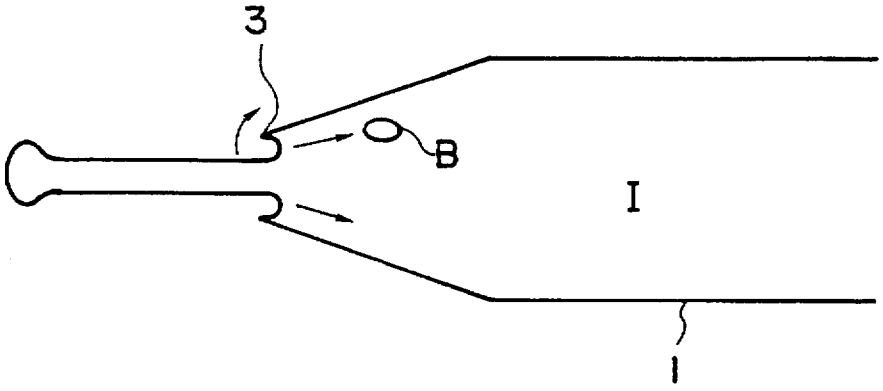
FIG.5 PRIOR ART
FIG. 5 is a typical figure showing air bubbles in the nozzle.
Figure 6:
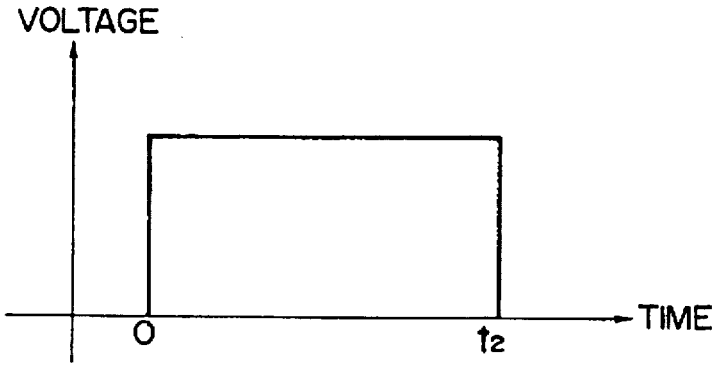
FIG.6 PRIOR ART
FIG. 6 is a typical figure showing another example of the driving pulse of the prior art.
Figure 7:
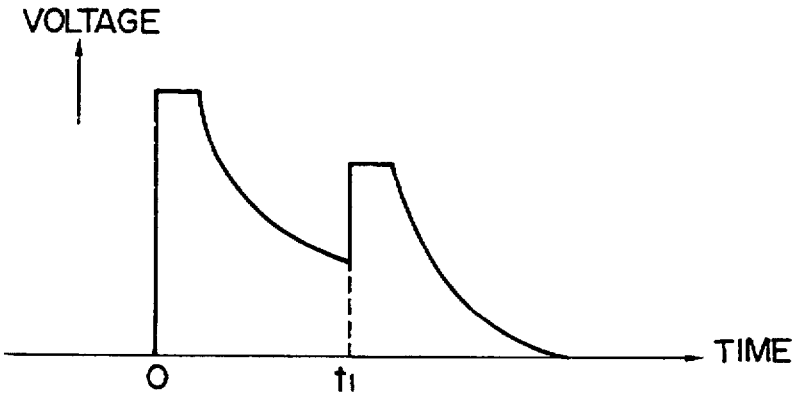
FIG.7 PRIOR ART
FIG. 7 is a typical figure showing still another example of the driving pulse of the prior art.

A compressed wave generated at the rise or lift of the main pulse on the time 0 is transmittted into two directions, and becomes expanded waves at a pressure generating point P to overlap each other as shown in FIG. 3. The compressed wave can be generated by causing the pulse to raise again thereby the pressures of the expanding waves from two directions being damped simultaneously. The pressure wave whose pressure is damped at the time $t_1$ transmits in the nozzle body with being reflected, and becomes the compressed wave again at the point P on the time $t_2$. At this time, the expanded wave is generated by causing a sub-pulse to fall or drop slowly, so that the compressed waves from two directions completely cancel each other.

In general, the pressure wave damps its energy while transmitting by viscosity, heat diffusion of the ink and the reflection. Accordingly, it is desirable to make the pressure of the pressure wave generated by the sub-pulse smaller than that which is generated by the main pulse. In the wave configuration shown in FIG. 8, because the rise of the main pulse is rather slow, the rising voltage b of the sub-pulse is about half of the rising a of the main pulse.

Figure 9:
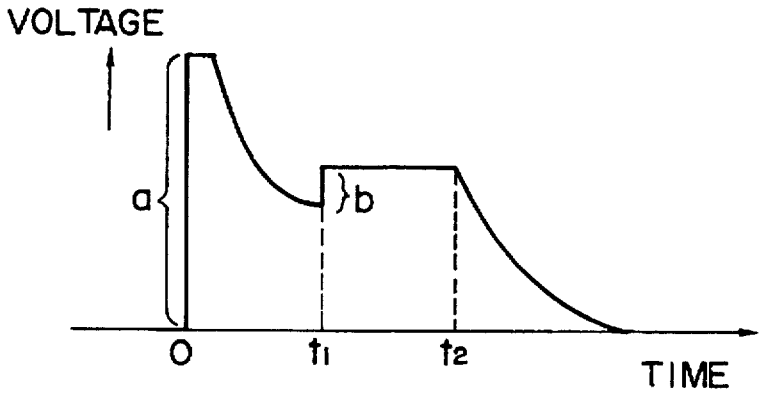

When the viscosity of the ink becomes high, the compressed wave generated by the rise of the main pulse has been fairly damped at the time $t_1$. For this reason, if the wave configuration shown in FIG. 8 is used as it is, the positive pressure due to the compression generated by the rise of the sub-pulse becomes larger than the negative pressure due to the expanding wave having been transmitted, which causes reversal of the phase of the pressure wave transmitting then after and results in the bad damping. Accordingly, in such a case, the wave configuration as shown in FIG. 9 in which the biasing voltage of the sub-pulse is made relatively lower than that of the main-pulse is used to adjust the relative value of the sub-pulse relative to the voltage of the main pulse corresponding to the ink viscosity, thus the pressure wave being desirably damped.

Figure 10:
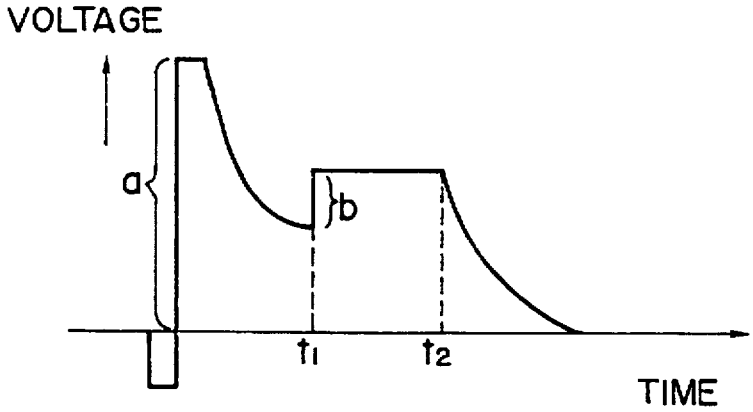

The above embodiment can be applied not only to the system in which the ink is discharged by the single pulse but also to the driving pulse of the ink jet recording head as shown in FIG. 10 in which the expanded wave is generated first and the compressed wave is generated second to discharge the fine ink droplet, thereby realizing the further reduction in the size of the dot used for recording.

As apparent from the above explanation, the pressure wave generated by the raising of the main pulse is divided into two directions to be reflected in the nozzle, causing the sub-pulse to raise at the time when converging to the pressure generating point after reversing its phase again, and causing the sub-pulse to fall after the time period equal to the rising time interval of the above two pulses has passed, and the reflected pressure waves can be cancelled in two steps.

Figure 11:
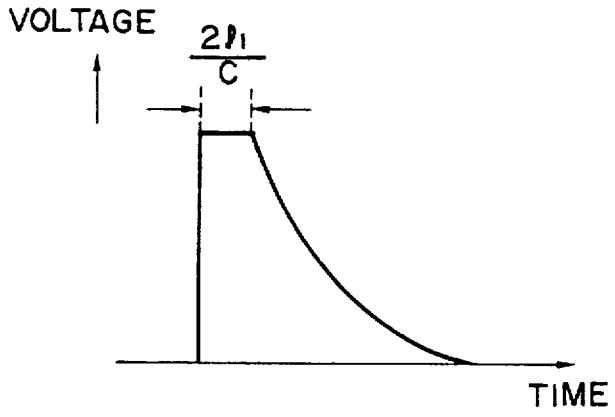

FIG. 11 shows another embodiment of the present invention, i.e. the voltage waveform biased to the piezoelectric element 4. The falling time of the voltage pulse is determined as $2l_1/C$ based on the distance $l_1$ between the intermediate portion of the ink path at which the piezo-electric element 4 is disposed and the ink discharge opening 3, and the velocity C at which the pressure wave is transmitted in the ink in the nozzle.

Figure 1:
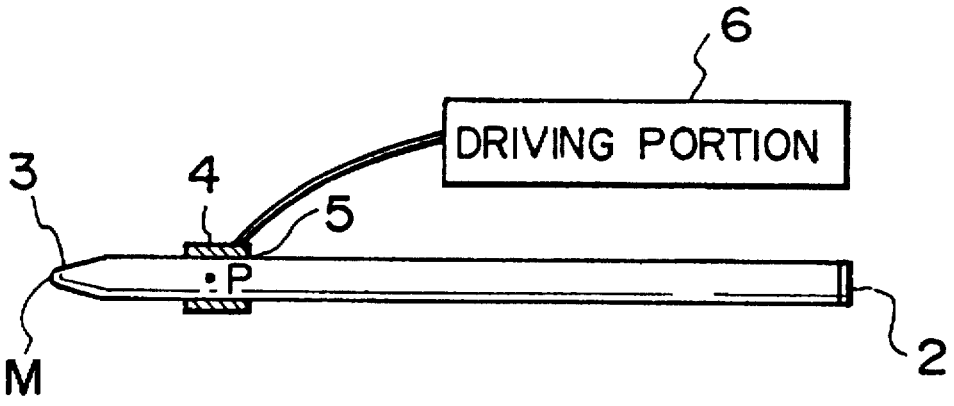
FIG. 1 PRIOR ART
FIG. 1 is a typical cross-section of an ink jet head of the prior art.
Figure 2:
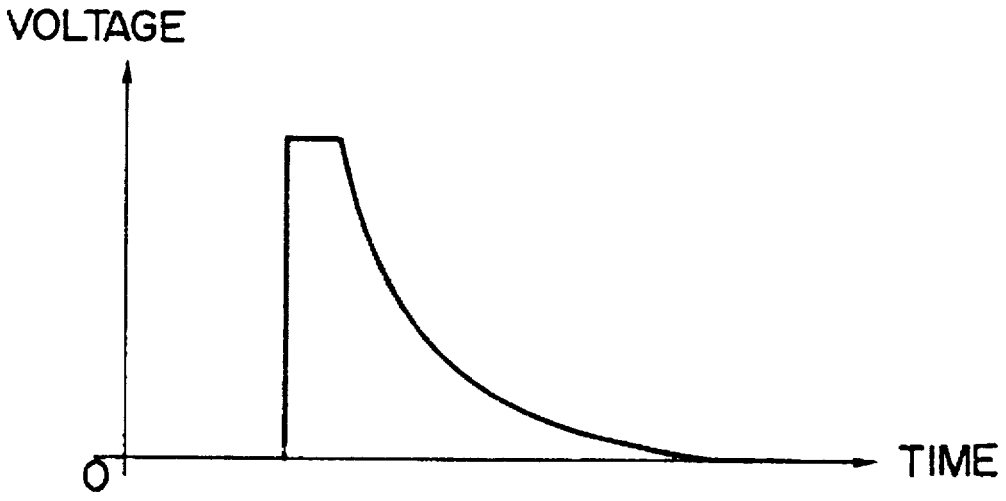
FIG. 2 PRIOR ART
FIG. 2 is a typical figure showing one example of a driving pulse of the prior art.
Figure 14:
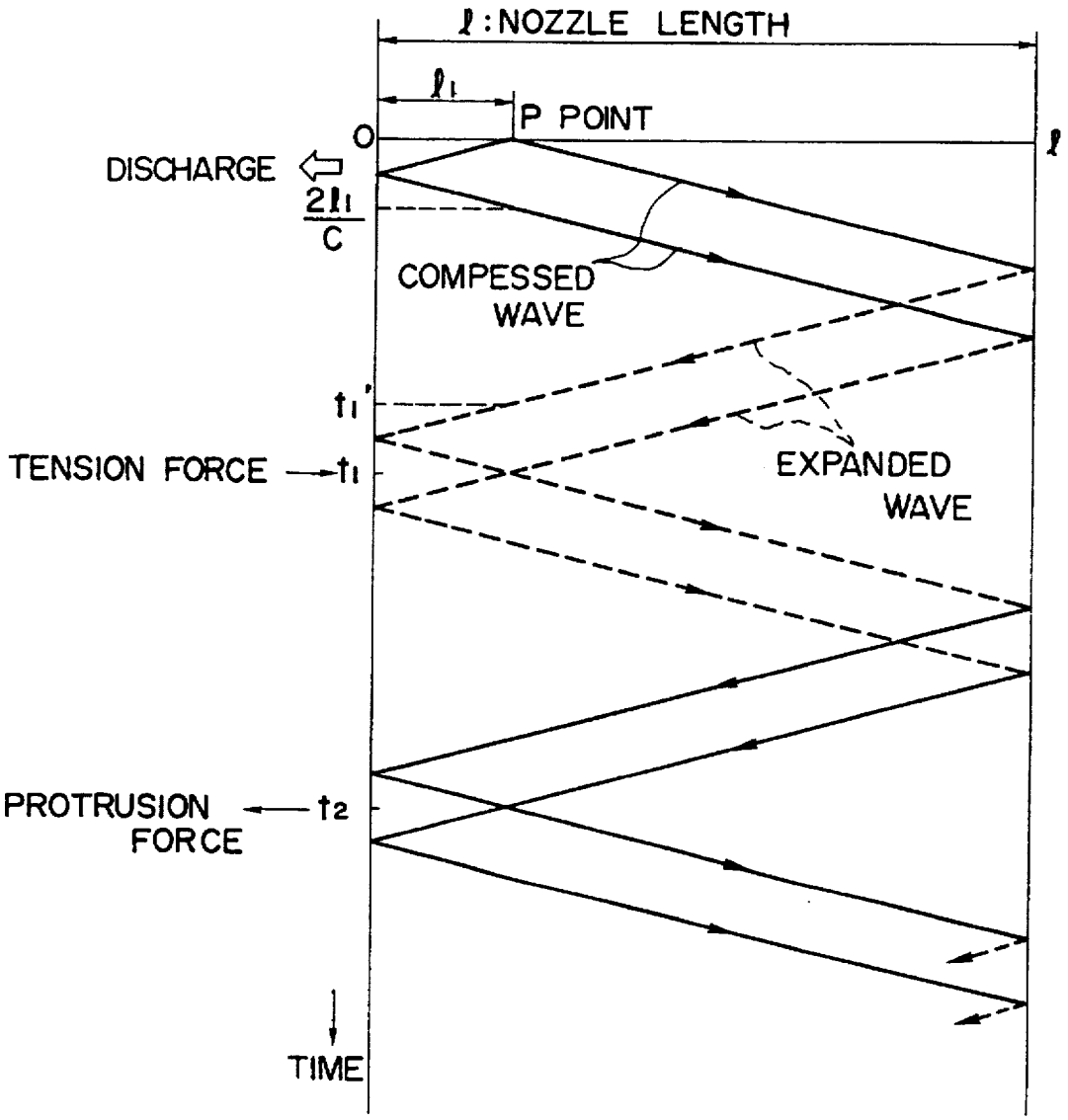
FIG. 14 is an another drawing for explaining the pressure wave being transmitted in the ink.

As a result as shown in FIG. 14, when the compressed wave transmitted toward the discharge opening 3 among the compressed waves generated by the rise of the voltage pulse, the period $2l_1/C$, the expanded wave are generated at the point P by causing the voltage pulse to fall slowly, while the pressure of the compressed wave is damped. As a result, the negative pressure according to the expanded wave acting on the discharge opening 3 about the time $t_1$ at which the pressure waves are overlapped in the first time at the point P of FIG. 1 is greatly damped, and the positive pressure of the compressed wave acting on the discharge opening 3 about the time $t_2$ at which the pressure waves are overlapped in the second time at the point P is greatly damped.

Incidently, since the negative pressure according to the expanded wave generated at the point P at the time $2l_1/C$ is small, the pressure when the expanded wave is transmitted to the discharge opening 3 can be ignored.

Figure 12:
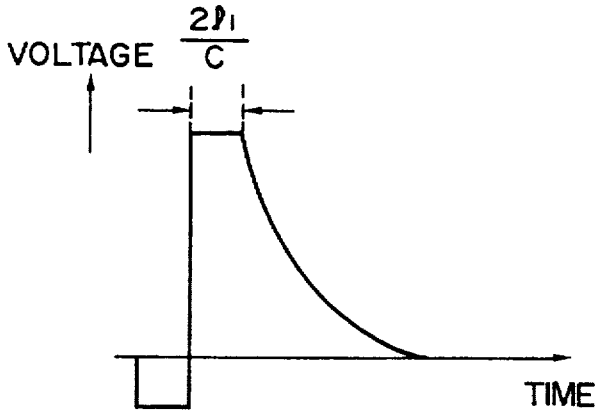

It is noted that this embodiment can be applied not only to the system in which the ink is discharged by the single pulse, but also to the driving pulse of the ink jet recording head in which the expanded wave is generated first, then the fine ink droplet is discharged by generating the compressed wave, thereby realizing further reduction in the dot used for the recording, as shown in FIG. 12.

Figure 13:
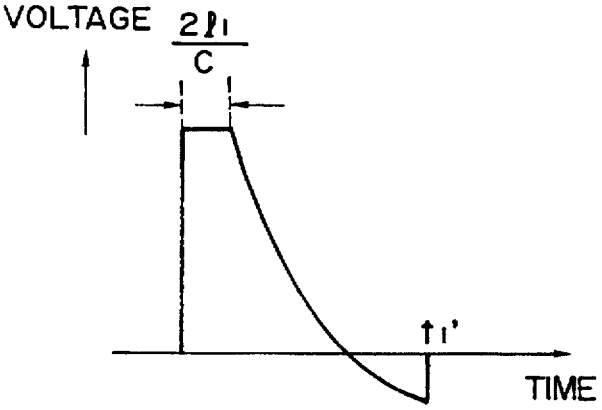

As shown in FIG. 13, if the voltage configuration is raised from minus to zero to generate the positive pressure at the point P, at the time $t_1$ when the expanded wave reflected by the filter 2 reaches the point P the first time, the pressure of the compressed wave transmitted toward the filter 2 among the compressed waves generated by the rise of the main pulse and tranmitted into two directions can be damped, so that the reflected pressure waves can be cancelled more effectively.

As apparent from the above, it is possible to damp the pressure of the reflected pressure wave by determining the falling time of the voltage pulse biased to the electric-mechanical converting element according to the distance between the electric-mechanical converting element and the discharge opening, and the relation of the transmission velocity of the pressure wave in the ink.

Figure 15:
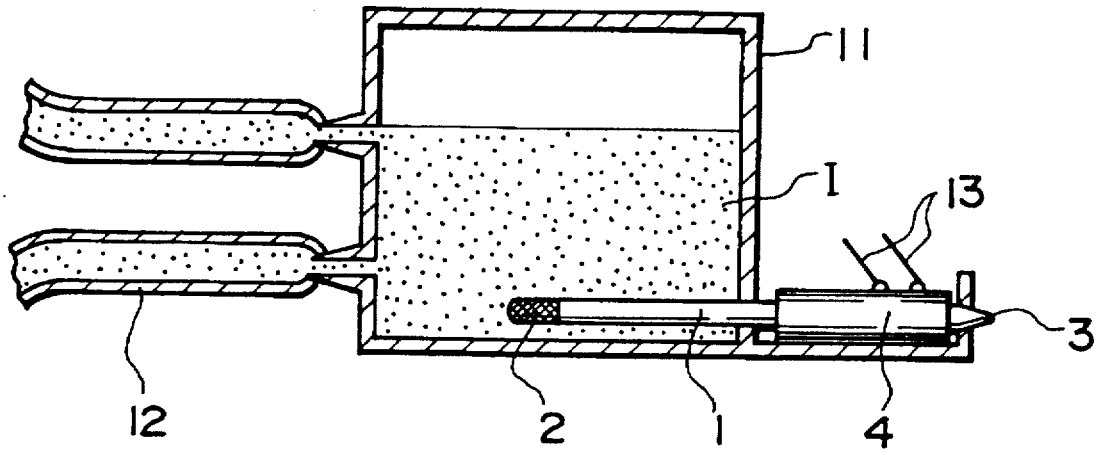
FIG. 15 is a typical cross-section of a main portion of an ink jet apparatus into which an ink jet head is incorporated.

FIG. 15 is a typical cross-section of a main portion of the ink jet apparatus into which the ink jet head of FIG. 1 is assembled.

In FIG. 15, the nozzle body 1 is fixed to a sub tank 11 via an adhesive such as epoxy group. To the sub tank 11, the ink I is supplied from the main tank (not shown) through the supplying tube 12. Numeral 13 shows the wires for delivering signal to piezo-electric element 4 from the driving portion 6 of FIG. 1.

The advantages as mentioned above can be obtained from all types of ink jet recording head, not limited to the Gould type or Silonics type, in which the recording is carried out by discharging the ink as the droplet from the discharge opening by applying the voltage pulse to the electric-mechanical converting element provided along the ink path.

Figure 16B:
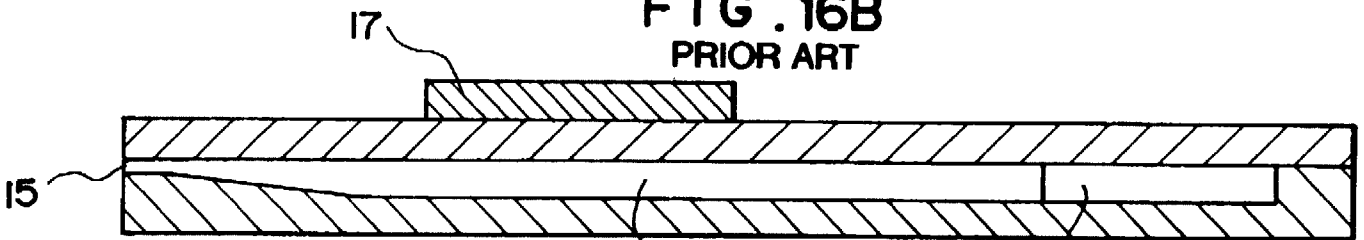
FIG. 16B PRIOR ART
FIG. 16B is a typical lateral cross-section in the line A—A' of the FIG. 16A.
Figure 16A:
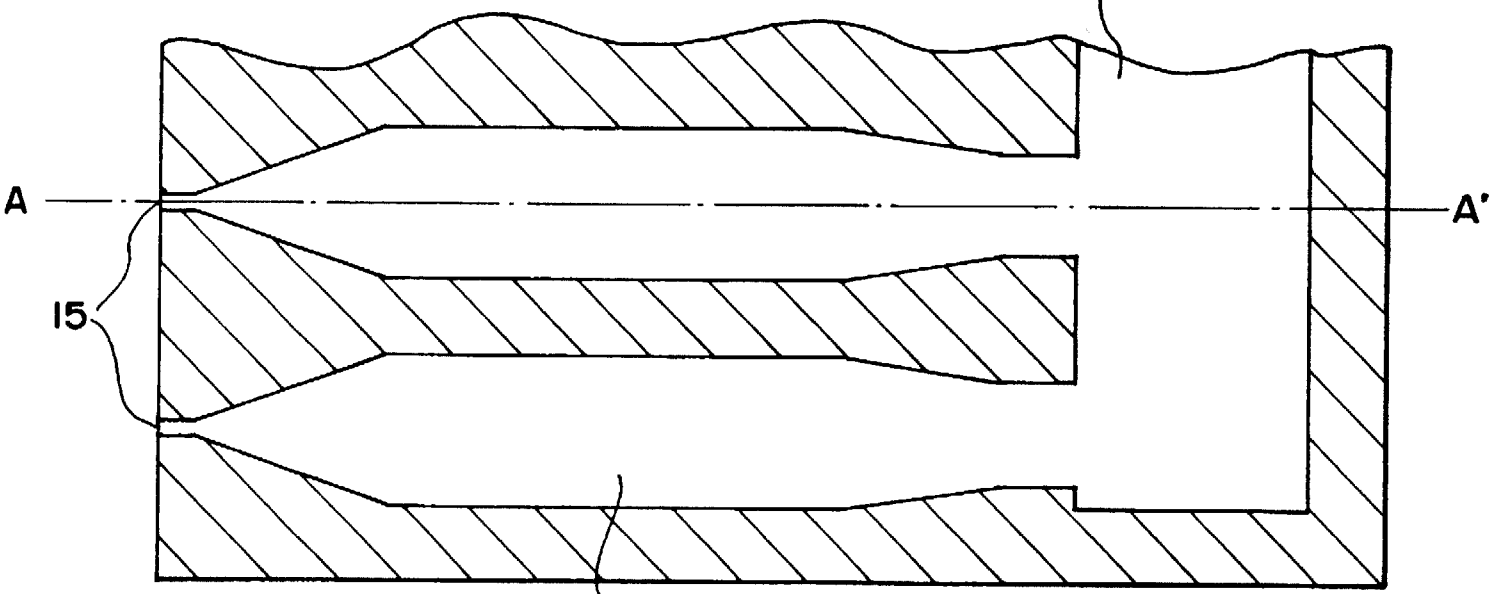
FIG. 16A PRIOR ART
FIG. 16A is a typical upper cross-section of a Silonics ink jet head.

A typical cross-section of the Silonics type ink jet head is shown in FIG. 16A, and a typical lateral cross-section along a line A—A' in FIG. 16B is shown in FIG. 16B.

In the FIGS. 16A and 16B, numeral 14 shows an ink path communicating with a discharge opening, and numeral 16 shows an ink chamber storing the ink for supplying the ink path. Numeral 17 shows a piezo-electric element for supplying the pressure to the ink within the ink path 14.

Figure 17:
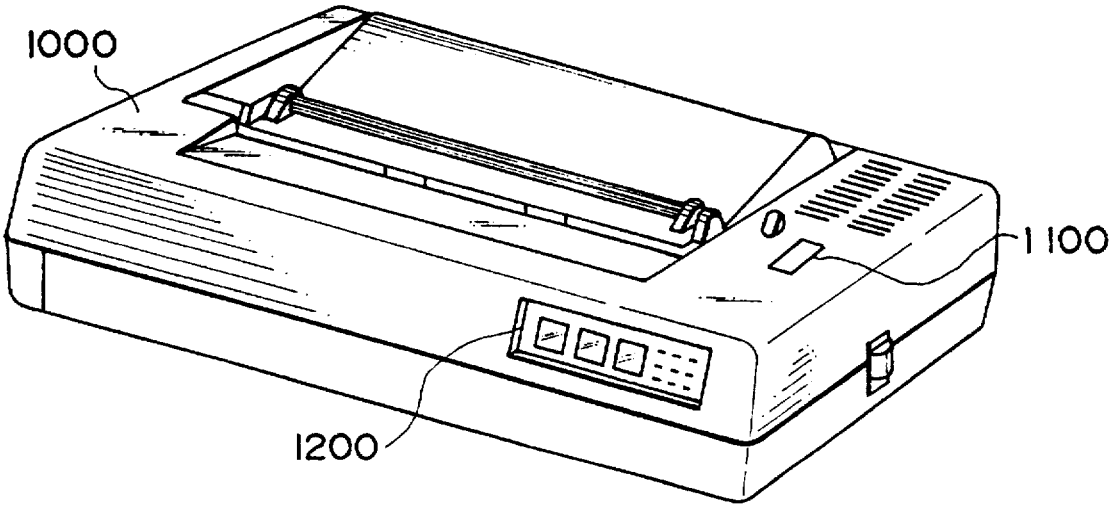
FIG. 17 is a typical perspective view of the ink jet apparatus provided with the ink jet head.

FIG. 17 is a typical perspective view of an ink jet apparatus provided with the ink jet head as mentioned above. In FIG. 17, numeral 1000 shows a main body of an apparatus, numeral 1100 shows a power switch, and numeral 1200 shows an operating pawl.

Heretofore, it was described as for the timing of the sub-pulse in the FIGS. 8 to 10, and the timing as for the main-pulse in the FIGS. 11 to 13, but it is noted that the present invention is by no means limited to these embodiments.

For example, more effective advantage can be obtained by dropping the main-pulse at the time when the time period $2l_1/C$ has passed after the rise of the main pulse of the FIG. 8.

Embodiment

The transmitting velocity of the pressure wave in the ink was measured according to the measuring method described in the FIG. 1 of "SID 87 DIGEST" (pages 186 to 188), "Pressure-Wave Generation in Impulse Ink-Jet Head Using Elongated Fluid-Filled Piezo-Electric Transducer" (Francis C. Lee) and the result was as below.

$C=1500$ m/s

Meanwhile, the discharging character was measured by usage of the ink head shown in FIG. 1 which is so configured to have the following dimensions.

$l=40$ mm, $l_1=7.5$ mm, discharging opening diameter=50 μm, ink supplying opening diameter=0.57 mm As the result, by the usage of the pulse formed under the following conditions, desirable result without trapping of the air bubbles and unnecessary discharge (high speed stabilized discharged) can be obtained, wherein $t_1$ of FIG. 8 (2l/C) is 53 μs, $t_2$ of FIG. 8 (4l/C) is 106 μs, maximum voltage valve (a) of FIG. 8 is 1100 V, and voltage value of FIG. 8 is 55 V.

Desirable result was also obtained by usage of the pulse formed under the conditions in which $2l_1/C$ in FIG. 11 is 10 μs, and the maximum voltage value in FIG. 11 is 110 V.

The ink used in the above embodiment has the following composition.

| | |
|---|---|
| water | 50% by weight |
| diethyleneglycol | 30% by weight |
| N-methyl-2-pyrrolidone | 10% by weight |
| polyethleneglycol | 10% by weight |
| dye, additive for controlling surface tension | |

In this way, air bubble trapping and unnecessary discharge of the ink droplet can be greatly reduced, which increases the stability of the ink discharge and greatly improves reliability of the ink jet recording apparatus.

Additionally, because the pressure wave after ink discharge can be cancelled quickly, large numbers of ink droplets can be discharged, which enables setting of the gradient range broadly. Furthermore, recording can be carried out at high speed by shortening the time period between the last bias of the voltage pulse and the next bias of the voltage pulse.

We claim:

1. An ink jet apparatus comprising:

an ink jet head having an ink path communicated with a discharge opening from which ink is discharged and an electric-mechanical converting element disposed along said ink path to provide a pressure generating point therein; and means for applying to said electric-mechanical converting element a driving pulse having a predetermined waveform falling when a time period of $2l_1/C$ has passed after rising, with said driving pulse being maintained for said time period and beginning to fall after said time period has passed, wherein $l_1$ is a length along said ink path from said discharge opening to a location in said ink path at the pressure generating point provided by said electric-mechanical converting element and C is the transmission velocity of a pressure wave in the ink in said ink path.

2. An ink jet apparatus according to claim 1, wherein said electric-mechanical converting element is a piezoelectric element.

3. An ink jet apparatus according to claim 1, wherein said electric-mechanical element surrounds a periphery of said ink path.

4. An ink jet apparatus according to claim 1, wherein said electric-mechanical element is provided along a portion of said ink path.

5. An ink jet apparatus according to claim 1, wherein a filter is provided at a portion of supply opening of said ink path.

6. A driving method of an ink jet head, the method comprising the steps of:

providing an ink jet head having an ink path communicated with a discharge opening from which ink is discharged and an electric-mechanical converting element disposed along the ink path to provide a pressure generating point therein; and applying to the electric-mechanical converting element a driving pulse having a predetermined waveform falling when a time period of $2l_1/C$ has passed after rising, wherein $l_1$ is a length along the ink path from the discharge opening to a location in the ink path at the pressure generating point provided by the electric-mechanical converting element and C is the transmission velocity of a pressure wave in the ink in the ink path.

* * * * *

UNITED STATES PATENT AND TRADEMARK OFFICE

CERTIFICATE OF CORRECTION

PATENT NO. 5,594,476

DATED : January 14, 1997

INVENTOR(S) : TATSUYUKI TOKUNAGA ET AL.

It is certified that error appears in the above-identified patent and that said Letters Patent is hereby corrected as shown below:

COLUMN 1

Line 17, "method" should read --driving method--.

COLUMN 2

Line 7, "return" should read --returns--.
Line 9, "succesively" should read --successively--.
Line 25, "danger" should read --danger of--.
Line 26, "and" should be deleted.
Line 30, "an" should be deleted.

COLUMN 3

Line 16, "other" should read --another--.
Line 38, "of" should read --for--.
Line 42, "openig" should read --opening--.
Line 51, "their" should read --in their--.

UNITED STATES PATENT AND TRADEMARK OFFICE

CERTIFICATE OF CORRECTION

PATENT NO. 5,594,476

DATED : January 14, 1997

INVENTOR(S) : TATSUYUKI TOKUNAGA ET AL.

It is certified that error appears in the above-identified patent and that said Letters Patent is hereby corrected as shown below:

COLUMN 4

Line 8, "nozzle." should read --nozzle,--.
Line 20, "incorporated." should read --incorporated,--.
Line 23, "FIG. 16A," should read --FIG. 16A, and--.

COLUMN 5

Line 5, "transmitting then" should read --transmitted there--.
Line 6, "the" should be deleted.

COLUMN 6

Line 1, "tranmitted" should read --transmitted--.
Line 16, "through the" should read --through--.
Line 17, "the" should be deleted.
Line 39, "pawl." should read --panel.--.
Line 67, "result" should read --results--.

UNITED STATES PATENT AND TRADEMARK OFFICE

CERTIFICATE OF CORRECTION

PATENT NO. 5,594,476

DATED : January 14, 1997

INVENTOR(S) : TATSUYUKI TOKUNAGA ET AL.

It is certified that error appears in the above-identified patent and that said Letters Patent is hereby corrected as shown below:

COLUMN 8

Line 18, "supply" should read --a supply--.

Signed and Sealed this

Fifth Day of August, 1997

Bruce Lehman

*Attest:*

BRUCE LEHMAN

*Attesting Officer*

*Commissioner of Patents and Trademarks*